US005088722A

United States Patent [19]

Olexy

[11] Patent Number: 5,088,722

[45] Date of Patent: Feb. 18, 1992

[54] DIVERTER ASSEMBLY

[75] Inventor: Anthony M. Olexy, Honeoye Falls, N.Y.

[73] Assignee: Eastman Kodak Company, Rochester, N.Y.

[21] Appl. No.: 625,237

[22] Filed: Dec. 10, 1990

[51] Int. Cl.[5] ..... B65H 39/10

[52] U.S. Cl. ..... 271/304

[58] Field of Search ..... 271/184, 185, 225, 279, 271/302-304

[56] References Cited

U.S. PATENT DOCUMENTS

| | | | |
|---|---|---|---|
| 3,472,506 | 10/1969 | Rabinow et al. | 271/64 |
| 3,724,657 | 4/1973 | Katagiri et al. | 271/302 |
| 3,931,920 | 1/1976 | Hellinger | 226/91 |
| 4,277,061 | 7/1981 | Nagel et al. | 271/302 |
| 4,351,492 | 9/1982 | Aoyama et al. | 242/18 |
| 4,416,378 | 11/1983 | Miller et al. | 209/583 |
| 4,420,153 | 12/1983 | Winkler et al. | 271/304 |
| 4,538,800 | 9/1985 | Richter | 271/120 |
| 4,709,913 | 12/1987 | Cagey | 271/279 |
| 4,785,942 | 11/1988 | Van Leijenhorst et al. | 271/303 |
| 4,874,958 | 10/1989 | Sampath et al. | 271/265 |
| 4,917,283 | 4/1990 | Weatherhead et al. | 226/190 |
| 4,958,828 | 9/1990 | Saito | 271/225 |

FOREIGN PATENT DOCUMENTS

| | | | |
|---|---|---|---|
| 407151 | 1/1991 | European Pat. Off. | 271/304 |
| 228352 | 11/1985 | Japan | 271/225 |
| 156272 | 6/1989 | Japan | 271/304 |
| 252457 | 10/1989 | Japan | 271/302 |
| 308355 | 12/1989 | Japan | 271/184 |
| 897194 | 5/1962 | United Kingdom | 271/279 |

*Primary Examiner*—Robert P. Olszewski
*Assistant Examiner*—Steven M. Reiss
*Attorney, Agent, or Firm*—G. Herman Childress

[57] ABSTRACT

A diverter assembly has a pair of spaced idler rollers located in spaced relation, and a grooved diverter roller which contacts both of the idler rollers. A sheet is fed along an entrance path between the idler rollers and into engagement with the diverter roller. The diverter is rotated in a first direction to deflect a sheet into a first exit path or in a second direction to deflect the sheet into a second exit path.

2 Claims, 2 Drawing Sheets

DIVERTER ASSEMBLY

BACKGROUND OF THE INVENTION

The present invention relates to a diverter assembly that is particularly useful for handling sheets of photographic film, for example.

Various kinds of diverter assemblies are known for redirecting a sheet of material from one path into another path while the sheet is being transported through a mechanism. Diverters for non-photographic sheets are known from U.S. Pat. No. 3,472,507, issued Oct. 14, 1969. This patent relates to a rotary diverter sorter that is especially useful for sorting flat articles rapidly and in large numbers. The sorted articles may comprise punch cards, postal letters, checks, coupons, transportation tickets or other documents read by optical or magnetic character reading machines. The articles are driven along an entrance path between a pair of drive belts and into engagement with a rotary diverter that can be rotated in either of two directions so that the leading edge of the article can be deflected by the diverter along either of two exit paths. The articles are directed into the nip between an idler roller and one of the drive belts or between a second idler roller and the other drive belt. Some diverter assemblies require the sheet to be bent through severe angles, and if a photographic film is bent at a severe angle it may be subjected to excessive pressure and other forces which can damage the emulsion on the film. Thus there is a need for a diverter assembly for handling photographic film which will divert the film from one path into another path with a high degree of reliability.

SUMMARY OF THE INVENTION

Accordingly, it is an object of the invention to provide an improved diverter assembly for sheets of sensitive material, such as photographic film, paper or the like, which can be deflected reliably from an entrance path to an exit path without subjecting the sheet to excessive pressures or other forces which could damage the sensitive emulsion coatings thereon. In accordance with the invention, a sheet diverting assembly is capable of diverting a sheet from an entrance path to either of two exit paths. The assembly has a pair of idler rollers located in spaced relation with the axes of the rollers being substantially parallel to each other. The rollers are located with respect to the entrance path so that a sheet traveling along the entrance path passes between the rollers. A diverter roller located between the axes of the idler rollers and offset from a plane passing through the axes of the idler rollers has an outer surface with a plurality of spaced grooves. The grooves extend along the surface in an axial direction and the grooved outer surface of the diverter roller is in contact with both of the idler rollers. A drive coupled to the diverter roller rotates the roller about its axes in a first direction to deflect the sheet traveling along the entrance path between the idler rollers into a nip between the diverter roller and a first one of the idler rollers and into one of the exit paths. The drive rotates the diverter roller in a second direction to deflect a sheet traveling along the entrance path between the idler rollers into a second nip between the diverter roller and a second one of the idler rollers and into the other of the exit paths.

The invention, and its objects and advantages will become more apparent in the Detailed Description of the Preferred Embodiment presented below.

BRIEF DESCRIPTION OF THE DRAWINGS

In the Detailed Description of the Preferred Embodiment of the invention presented below, reference is made to the accompanying drawings, in which.

DETAILED DESCRIPTION OF THE PREFERRED EMBODIMENT

Figure 1:
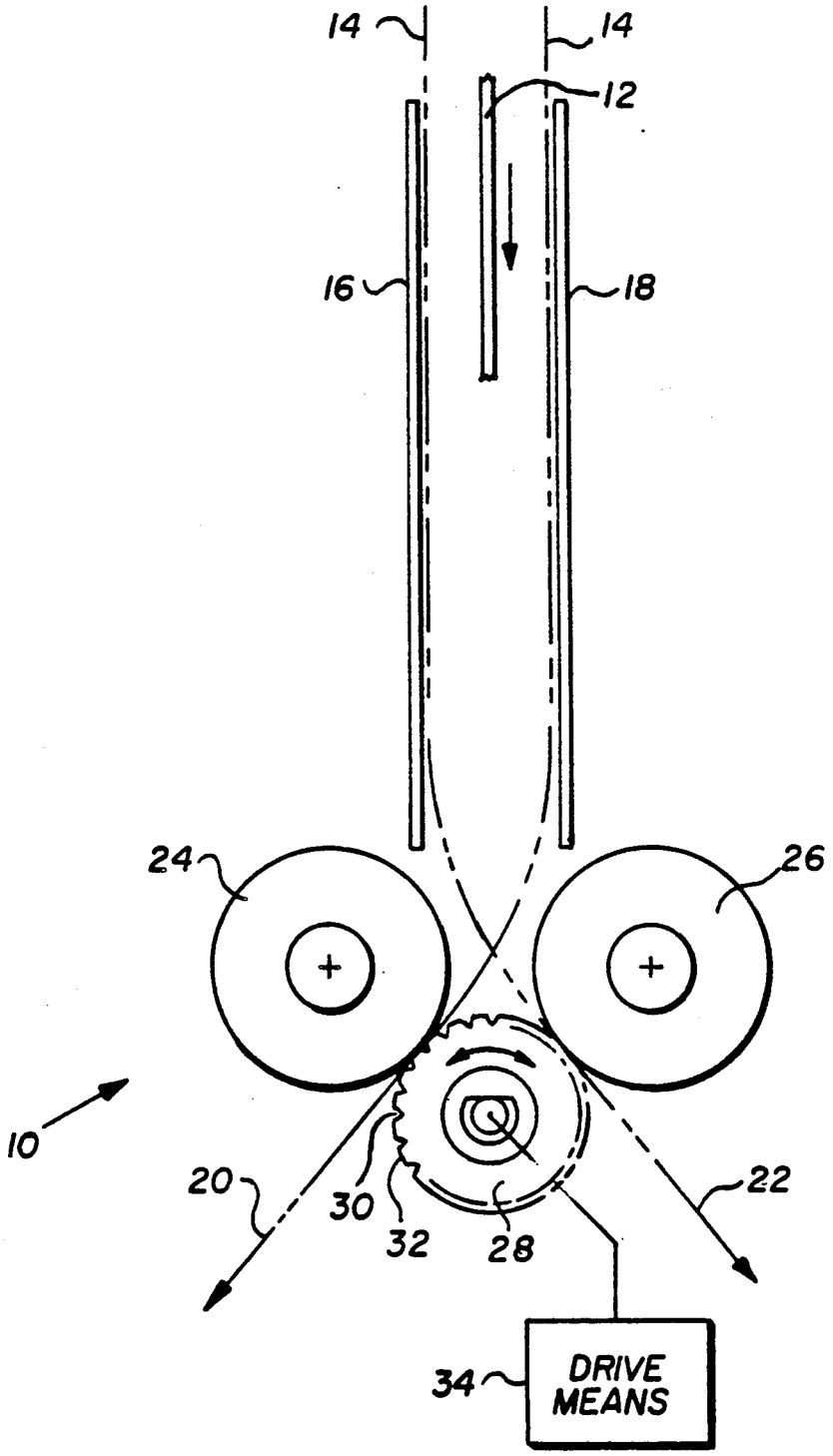
FIG. 1 is a view showing a diverter assembly positioned to receive a sheet delivered along an entrance path and to deflect the sheet into either of two exit paths.

Referring now to the drawings, a diverter assembly of the present invention is generally designated 10 and is adapted to receive a sheet 12 moving along an entrance path 14 defined by a pair of film guides 16, 18. Diverter assembly 10 can deflect a sheet 12 into either of two exit paths 20, 22 as explained in more detail later.

Figure 3:
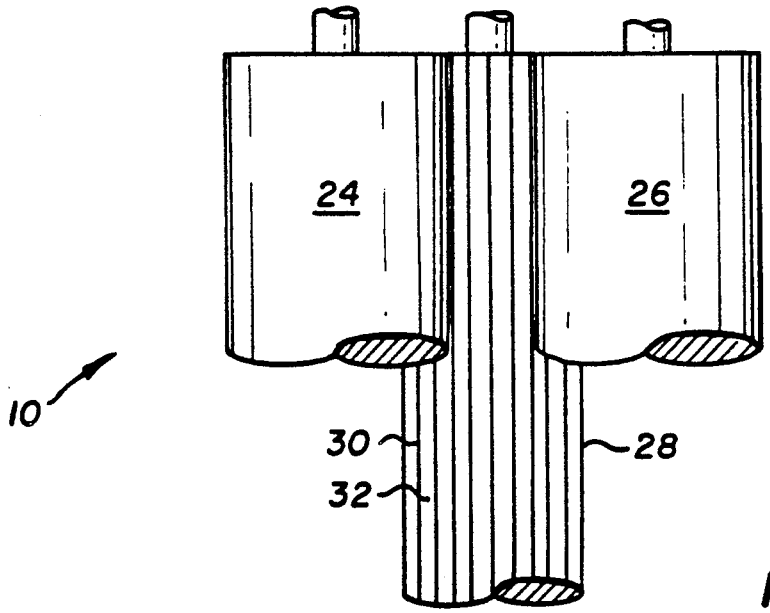
FIG. 3 is a fragmentary plan view of the diverter assembly.

Assembly 10 comprises a pair of cylindrical idler rollers 24, 26 and a generally cylindrical diverter roller 28. Rollers 24, 26 are substantially the same diameter and length, and the diverter roller is slightly smaller in diameter. The idler rollers 24, 26 are located in spaced relation and the axes of the rollers are substantially parallel to each other, as illustrated in FIG. 3. The spacing between the outer surfaces of the rollers 24, 26 is at least slightly greater than the width of the sheet 12 fed to the assembly through the guides 16, 18 and can be spaced by a distance at least equal to, or greater than, the space between guides 16, 18. Rollers 24, 26 are located with respect to the entrance path 14 so that a sheet traveling along the entrance path will pass between the rollers. Thus, the lower ends of guides 16, 18 are effective to direct the sheet into the space between rollers 24, 26.

Diverter roller 28 has an axis located between the axes of the idler rollers 24, 26 and substantially in line with the path 14 for sheets traveling between guides 16, 18. The axis of the diverter roller 28 is offset from a plane passing through the axes of the idler rollers with the diverter roller being on one side of such plane while the guides 16, 18 are on the opposite side of such plane.

Diverter roller 28 has on its surface a plurality of equally spaced grooves 30 which preferably extend the full length of the roller and are generally parallel to each other and the axis of the roller. Grooves 30 are separated by projections 32 on the surface of the roller.

Figure 2:
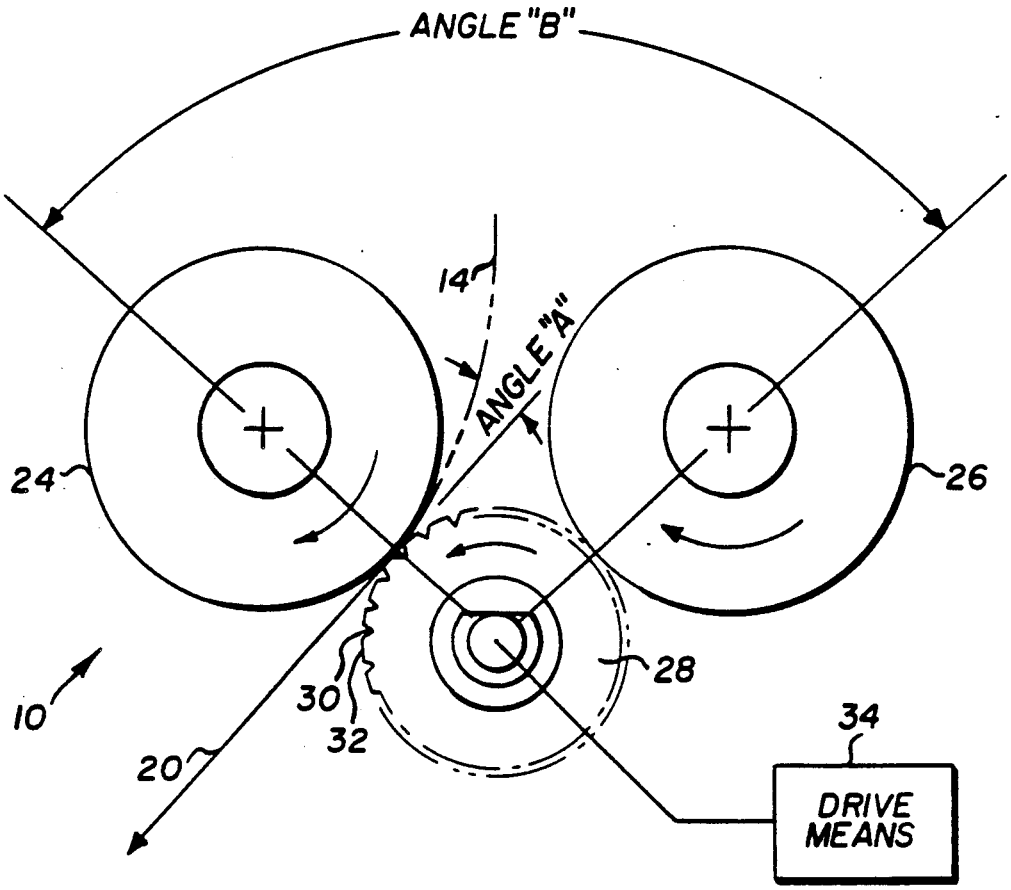
FIG. 2 is an enlarged view of the diverter assembly illustrating its operation.

The grooved outer surface of roller 28 is in contact with the smooth outer surface of both of the idler rollers 24, 26, as shown in FIGS. 1 and 2. Also, roller 28 is coupled to a reversible drive means, diagrammatically shown at 34, which enables the roller to be rotated in either a clockwise or counterclockwise direction. Rotation of roller 28 drives the rollers 24, 26 in the opposite direction from roller 28.

When roller 28 is driven in a counterclockwise direction, as viewed in FIGS. 1 and 2, rollers 24, 26 are driven in a clockwise direction. A sheet 12 traveling along the entrance path 14 enters the space between the rollers 24, 26 and engages the surface of roller 28 anywhere between the nip defined by rollers 24, 28 and the nip defined by rollers 26, 28. Grooved roller 28 will deflect the sheet into the nip between rollers 24, 28 so that the sheet is driven into the exit path 20. On the other hand, when the grooved roller 28 is driven in a clockwise direction the idler rollers 24, 26 are driven in counterclockwise directions. Under these conditions, a sheet 12 traveling along path 14 is deflected by the grooved surface of roller 28 into the nip between rollers 26, 28 and thus be deflected into the second exit path 22.

The diverter assembly can be used in various types of apparatus. One preferred application is in a printer which exposes a latent image on sheets 12 of x-ray film and thin feeds the sheets into path 14. The sheets can be delivered by the diverter assembly along path 20 to a film processor (not shown) for immediate processing of the latent images on the sheets. Alternatively, the sheets can be delivered along path 22 to a magazine (not shown) and stored in the magazine until it can be transported to a processor for development of the latent image.

The presence of grooves 30 and projections 32 on roller 28 are important for reliably feeding a sheet 12 of film or other material into the desired exit path. If the surface of roller 28 was smooth, then it would be necessary to rely on the coefficient of friction between the edge of the film and the diverter roller 28 to provide the force necessary to deflect the leading edge of the film from path 14 into the desired "pinch point" between roller 28 and one of the idler rollers 24, 26. The amount of force developed from such friction is the prime factor in determining the minimum angle A that the film can be reliably diverted. The presence of the grooves 30 and projections 32 greatly increases the coefficient of friction and thus provides a relatively large angle A through which a sheet can be reliably diverted from path 14 into one of the exit paths. The surface of roller 28 allows the leading edge of the film to encounter the diverter roller at a more acute angle A, and thus allows the edge to be reliably moved through a greater angle B (FIG. 2) defined by planes through the axis of rollers 26, 28 and rollers 24, 28. As angle B increases, the amount of bending that the film must experience to be diverted decreases, as does the probability of damage from excessive forces exerted on the film from the film guides 16, 18 leading to the diverter assembly.

Among the advantages of the invention is the reliability for feeding sheets through relatively large angles A and B as explained above. In addition, the grooved roller 28 permits the space between guides 16, 18 and between the rollers 24, 26 to be relatively large compared to the width of the sheet 12 without adversely effecting the ability of the assembly to feed sheets to the desired exit path. By opening up the spacing between guides 16, 18, and thus reducing the bending of sheet 12, the diverter assembly becomes desirable for use with photographic sheets or strips which have emulsions thereon that may be damaged by sharply bending the sheet or strip.

The invention has been described in detail with particular reference to a preferred embodiment thereof, but it will be understood that variations and modifications can be effected within the spirit and scope of the invention.

I claim:

1. An assembly for diverting a sheet from an entrance path to either of two exit paths, the assembly comprising:

a pair of idler rollers located in spaced relation with the axes of the rollers being substantially parallel to each other, the rollers being located with respect to the entrance path so that a sheet traveling along the entrance path passes between the rollers, a diverter roller having an axis located between the axes of the idler rollers and offset from a plane passing through the axes of the idler rollers, the diverter roller having an outer surface with a plurality of spaced grooves extending along the surface in an axial direction, the grooved outer surface being in contact with both of the idler rollers, drive means coupled to the diverter roller for rotating the diverter roller about its axis in (1) a first direction to deflect a sheet traveling along the entrance path between the idler rollers into a first nip between the diverter roller and a first one of the idler rollers and into one of the exit paths or (2) a second direction to deflect a sheet traveling along the entrance path between the idler rollers into a second nip between the diverter roller and a second one of the idler rollers and into the other of the exit paths, and a pair of spaced guides defining the entrance path, the guides being located on one side of a plane passing through the axes of the idler rollers, the diverter roller being on the opposite side of such plane, and the entrance path being free of deflectors between the guides so that a sheet is deflected into the first nip or the second nip by the diverter roller.

2. An assembly as set forth in claim 1 wherein the grooves in the diverter roller are substantially parallel to each other and to the axis of the diverter roller, and the idler rollers each having a substantially smooth outer surface.

* * * * *